US007823623B2

(12) United States Patent
Fitzsimon et al.

(10) Patent No.: US 7,823,623 B2
(45) Date of Patent: Nov. 2, 2010

(54) BELT CASTING MACHINE HAVING ADJUSTABLE CONTACT LENGTH WITH CAST METAL SLAB

(75) Inventors: John Fitzsimon, Belleville (CA); Ronald Roger Desrosiers, Kingston (CA); Willard Mark Truman Gallerneault, Glenburnie (CA); Kevin Michael Gatenby, Kingston (CA)

(73) Assignee: Novelis Inc., Toronto, Quebec (CA)

( * ) Notice: Subject to any disclaimer, the term of this patent is extended or adjusted under 35 U.S.C. 154(b) by 74 days.

(21) Appl. No.: 11/724,449

(22) Filed: Mar. 15, 2007

(65) Prior Publication Data

US 2007/0215314 A1 Sep. 20, 2007

Related U.S. Application Data

(60) Provisional application No. 60/783,767, filed on Mar. 16, 2006.

(51) Int. Cl.
*B22D 11/06* (2006.01)

(52) U.S. Cl. ..... 164/481; 164/431; 164/432; 164/479

(58) Field of Classification Search ..... 164/481, 164/431, 432, 479
See application file for complete search history.

(56) References Cited

U.S. PATENT DOCUMENTS 3,163,896 A 1/1965 Rochester et al.
3,167,830 A 2/1965 Hazelett et al.
3,700,027 A 10/1972 Petersen
3,828,841 A 8/1974 Hazelett et al.
3,848,658 A 11/1974 Hazelett et al.
4,061,178 A * 12/1977 Sivilotti et al. ..... 164/481
4,193,440 A 3/1980 Thorburn et al.
4,367,783 A 1/1983 Wood et al.
6,026,887 A * 2/2000 Dykes et al. ..... 164/481
6,755,236 B1 6/2004 Sivilotti et al.

(Continued)

FOREIGN PATENT DOCUMENTS

EP 0 008 901 B 8/1983

(Continued)

OTHER PUBLICATIONS

English translation of foreign patent document JP 62077159.

(Continued)

*Primary Examiner*—Jessica L Ward
*Assistant Examiner*—Devang R Patel
(74) *Attorney, Agent, or Firm*—Cooper & Dunham LLP

(57) ABSTRACT

A twin-belt casting machine for casting metal strip. The machine is provided with a casting cavity which includes an upstream fixed casting region, in which the belts are in fixed convergent paths in contact with the cast slab, and an adjacent downstream portion in which the belts are adjustable between alignment with the fixed convergent paths and non-alignment therewith (being less convergent or divergent). When the adjustable portions of the paths are moved outwardly relative to the fixed convergent paths, the belts separate from the cast slab at differing predetermined points within the casting cavity. By adjusting the downstream portion of the casting cavity in this manner, the casting machine can operate at essentially constant throughput for a wide range of alloys while ensuring that the cast slab exiting the caster has a temperature within a predetermined range suitable for further rolling to produce sheet product.

13 Claims, 3 Drawing Sheets

U.S. PATENT DOCUMENTS

2004/0168789 A1 * 9/2004 Wyatt-Mair et al. ..... 164/479

FOREIGN PATENT DOCUMENTS

| | | | |
|---|---|---|---|
| JP | 58148056 | A2 | 9/1983 |
| JP | 62 024845 | A | 2/1987 |
| JP | 62077159 | A2 | 4/1987 |
| WO | WO 97/18049 | | 5/1997 |

OTHER PUBLICATIONS

European Patent Office, Supplementary European Search Report (Jan. 4, 2010), European Patent Appl'n. No. 07710742.3-2122 (Novelis Inc.).

* cited by examiner

BELT CASTING MACHINE HAVING ADJUSTABLE CONTACT LENGTH WITH CAST METAL SLAB

CROSS-REFERENCE TO RELATED APPLICATIONS

This application claims the priority right of our prior U.S. provisional patent application Ser. No. 60/783,767 filed Mar. 16, 2006.

BACKGROUND OF THE INVENTION (1) Field of the Invention

This invention relates to a process and apparatus for the continuous belt casting of metal strips and, particularly, to the twin-belt casting of metal strips from a variety of molten metals having different cooling requirements and characteristics.

(2) Description of the Related Art

Twin-belt casting of metal strips typically involves the use of a pair of endless belts, usually made of flexible, resilient steel bands or the like, which are driven over suitable rollers and other path defining means, so that they travel together along opposite sides of an elongated narrow space, typically downward-sloping or horizontal, which forms a casting cavity. Molten metal is introduced between the belts in the vicinity of the upstream entry end of the casting cavity and the metal is discharged as a solidified strip or slab from the downstream exit end of the cavity.

An example of a twin-belt casting system can be found in Rochester et al. U.S. Pat. No. 3,163,896, issued Jan. 5, 1965. That patent describes a casting machine in which each belt is circulated, in turn, around a tension roll, a guide roll, at least a pair of sizing rolls and a power roll. The belts are maintained in position to form a casting cavity by the guide rolls and the sizing rolls, such that the cavity after the last sizing roll diverges before feeding onto the power rolls. The sizing rolls, in combination the guide rolls, press against the opposite sides of the belts throughout the cooling and solidification region, and serve to maintain (adjustably, if desired) the selected, predetermined distance between the belts, depending on the thickness desired in the resulting cast strip.

In Hazelett et al. U.S. Pat. No. 3,167,830, issued Feb. 2, 1965, a twin-belt casting apparatus is described in which the upper and lower belt assemblies can be moved with respect to each other so as to affect the cavity length/position. This is used to permit flexibility in the type of operation, e.g. pool vs. direct nozzle feed, and thickness. The flexibility does not affect the cavity length when measured as the total length in which the belt actually confines the slab.

Wood et al. U.S. Pat. No. 4,367,783, issued Jan. 11, 1983, describes a further twin-belt casting system in which load cells are used to measure the pressure applied to a shrinking metal slab and are the results are then used to apply a corrective taper to the cavity. This adjustment to the taper does not affect the length of the cavity.

A still further design is described in Braun et al. WO 97/18049 published May 22, 1997 . This document describes a block caster which can be adapted to have a belt-type liner, and hence behave as a belt caster backed up by a series of connected blocks. The taper of the cavity can be adjusted to meet various metallurgical needs, but there is no description of a system for varying the contact length with the cast strip.

Different alloys, e.g. foil alloys versus can-end or automotive alloys, have remarkably different heat flux requirements, i.e. they require very different heat extraction rates to ensure that a good quality cast slab is obtained. As a result, a caster designed to cast foil alloys, requiring a relatively low heat extraction, will have a relatively long cavity. If the same caster is used with a high heat flux suitable for can-end or similar alloys, the amount of slab cooling that occurs along the cavity is too high and the exit temperature of the slab is too low for subsequent processing (e.g. rolling). If the overall convergence of the cavity is lessened to compensate, the surface quality of the slab deteriorates. Thus, there remains a need for a twin-belt caster that, for a wide range of aluminum alloys, can operate at essentially constant throughput yet ensure that the cast slab exiting the caster has a temperature lying within a predetermined temperature range suitable for further rolling to produce a desired sheet product.

SUMMARY OF THE INVENTION

An exemplary embodiment of the present invention relates to a twin-belt casting system for continuously casting a metal slab in strip form directly from molten metal in which the molten metal is confined and solidified in a parallel, or more usually convergent, casting cavity defined by upper and lower cooled, endless, flexible travelling casting belts supported by respective upper and lower belt supporting mechanisms. In such an embodiment, the portion of the casting belts in direct contact with the cast slab can be mechanically changed within the casting cavity so as to ensure that the slab exit temperature lies within a desired predetermined range, and yet the casting cavity characteristics (e.g. convergence) can be maintained sufficiently high in the upstream end to ensure that good slab quality is achieved for all alloys. This is achieved according to the exemplary embodiment by providing supporting mechanisms for the belts which permit adjustment between one position, in which the cavity is parallel or uniformly convergent and the belts are in contact with the slab substantially along its entire length, and one or more other positions in which the cavity is adapted to switch from parallel or convergent to a different slope, e.g. a less convergent or divergent angle, at a mid-region of the cavity sufficient to break contact between the belts and the cast slab. The sections of different slope may include belts in parallel or divergent paths. With such an arrangement, the first section of the belt remains in contact with the slab over its entire length, whereas the section of different slope (e.g. the less convergent or divergent section) is taken out of contact with the slab and so does not extract heat from the slab.

In one illustrative embodiment, the belt is carried by supporting blocks which are typically cooling blocks. One or more of these supporting blocks are mounted on a tiltable assembly whereby they can be adjusted to a position which forces the section of the belts travelling over the tilted supporting blocks from a parallel or convergent path, in which the belts are in contact with the cast slab, to a path in which contact between the belts and the cast slab is broken.

Embodiments of the invention also apply to twin-belt casters which use a series of supporting rollers for the belts. In a similar manner as described for the supporting blocks, groups of support rollers may be mounted on tiltable assemblies adapted tilt the belts out of contact with the cast slab at a predetermined location within the casting cavity.

Reducing the portion of the cavity in contact with the slab in the above manner significantly reduces the amount of heat being removed from the slab and therefore prevents any overcooling effect. Where an alloy requiring a lower heat flux for casting is being processed, the tilt mechanism is pivoted so as to bring a greater portion of the casting cavity in contact with the slab, and thus ensure that the slab leaves the casting cavity at substantially the same exit temperature as other metals requiring a higher heat flux. This may require having the entire length of the casting cavity in contact with the slab.

Thus, embodiments of the present invention provide a casting machine that, for a wide range of metal alloys (e.g. aluminum alloys), can operate at essentially constant throughput while ensuring that the cast slab exiting the caster has a temperature lying within a predetermined range suitable for further rolling to produce a sheet product. This means that parameters can be established for different alloys and exit temperature requirement so that, depending on those requirements, the position of the adjustable portion of the casting region can be set prior to a casting run.

The fixed portion of the casting cavity preferably converges, most preferably with a convergence of about 0.015% to 0.025% (corresponding to the linear shrinkage of the solidified slab), while the adjustable portion may be moved between a position having the same convergence as the fixed portion, and another position having a divergence of as much as 1.0% to significantly reduce the rate of heat extraction through the belts once solidification is appreciably complete.

Another exemplary embodiment provides a method of operating a twin-belt caster having rotating belts provided with confronting sections of fixed length to form cast metal strip products from at least two molten metals having different cooling requirements in different casting operations. The method involves establishing for each metal the length and convergence (which may include parallel casting surfaces) of a casting cavity within the caster required to produce a cast product of predetermined characteristics, and, prior to casting each one of the metals, adjusting the paths of at least one of the twin belts in the confronting sections to form an upstream casting cavity having a length and convergence corresponding to those established for the metal to be cast, and a downstream region where the belts loose contact with the metal and cease to exert a significant cooling effect. This makes the casting apparatus more versatile in that many different metals may be cast in a caster having belts provided with confronting sections of fixed length without compromising the desired characteristics, as well as the desired exit temperatures, of the cast products.

DESCRIPTION OF THE PREFERRED EMBODIMENTS

Figure 1:
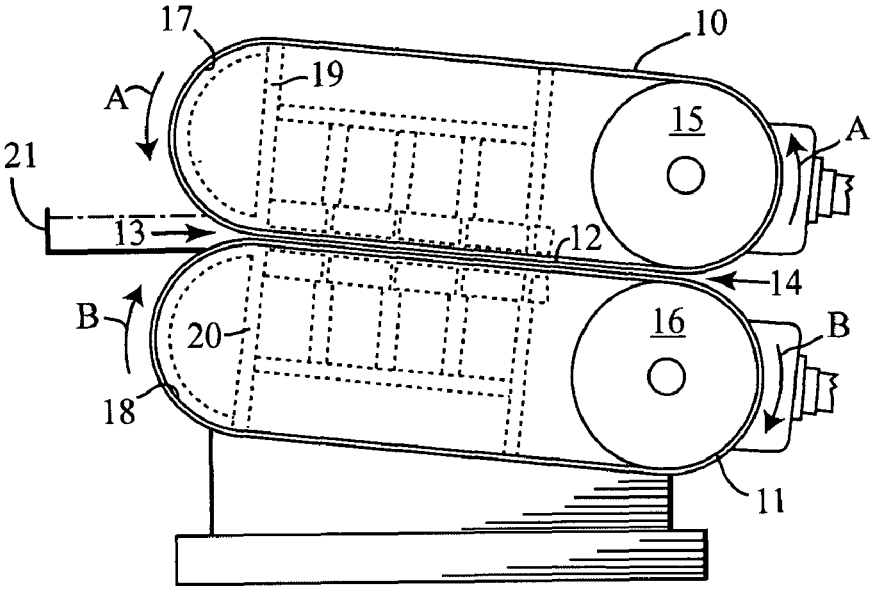
FIG. 1 is a general side view in very simplified form of a twin-belt casting apparatus in which the present invention may be utilized.

Referring to the drawings, an example of a basic belt casting machine to which the present invention may be applied is shown in FIG. 1. It includes a pair of resiliently flexible, heat conducing metal bands, forming upper and lower endless belts 10 and 11. These belts travel in looped paths in the directions of arrows A and B so that, in traversing a region where they are close together (i.e. a confronting section of fixed length), the belts define a casting cavity 12 (parallel or slightly converging) extending from a liquid metal entrance end 13 to a solid strip discharge exit end 14. The belts 10 and 11 are respectively driven and carried around by large drive rollers 15 and 16, to return toward the entrance end 13, after passing around curved, liquid-layer bearing structures, respectively shown at 17 and 18. Supporting carriage structures 19 and 20 are provided for the respective belts 10 and 11, while the drive rolls 15 and 16 are appropriately carried and connected for suitable motor drive, all by well known means.

The molten metal is fed to the casting cavity 12 by any suitable means, e.g. from a continuously supplied trough or launder 21. As the liquid metal in the cavity 12 moves along with the belts, it is continuously cooled and solidified, from the outside to the inside, from its contact with the belts, so that a solid, cast strip (not shown) is continuously discharged from exit end 14. Convenient means for cooling the belts may typically be in the form of a series of cooling "pads" which contain chambers for coolant, e.g. water, and a multiplicity of outlet nozzles arranged so as to cover the area facing the reverse surface of each belt, with a slight spacing from the belt so that jet streams of liquid coolant projected perpendicular against the belt through the nozzle faces flow outwardly over the face, returning to the appropriate discharge means. The preferred nozzles for this purpose are those having a flat guiding face of hexagonal contour as described in Thorburn et al. U.S. Pat. No. 4,193,440, issued Mar. 18, 1980, and incorporated herein by reference.

Figure 2:
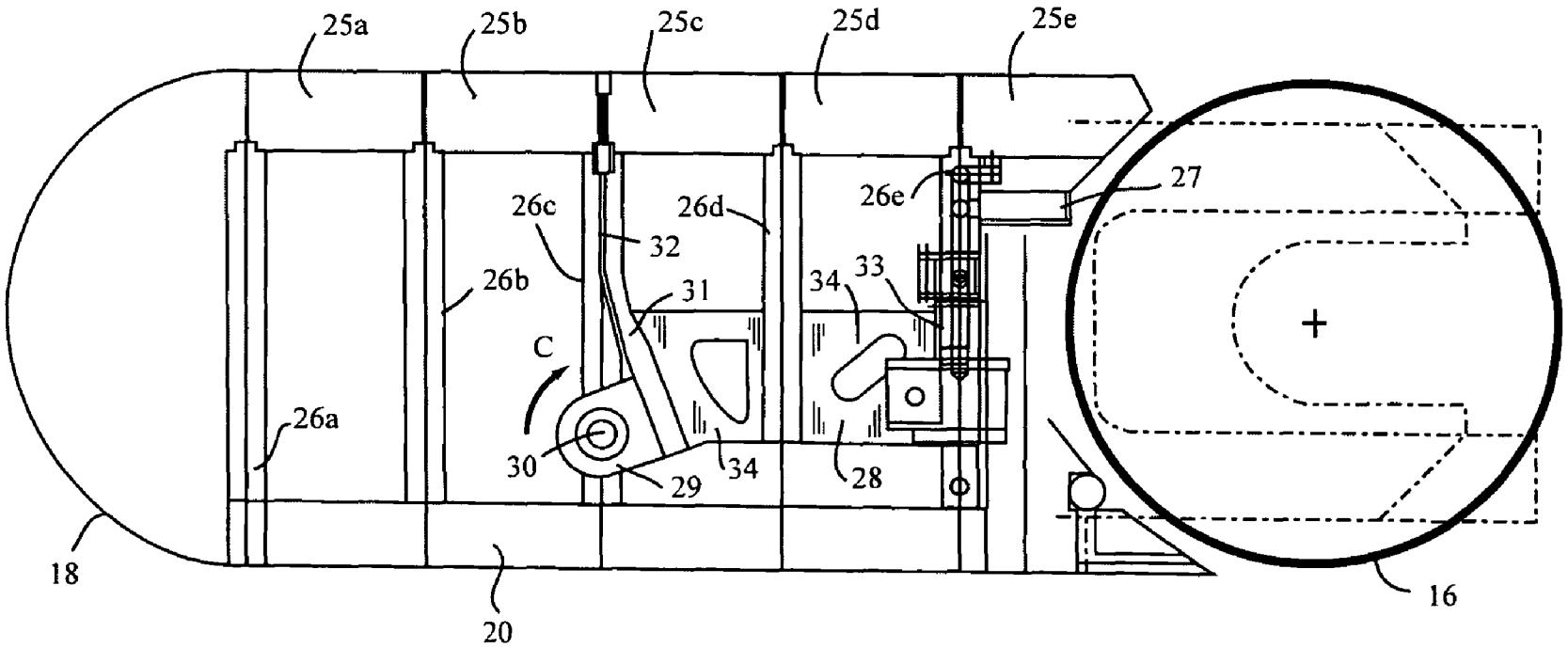
FIG. 2 is a simplified sectional view of the belt support mechanism of a belt caster showing an embodiment of the invention.

As can be seen in FIG. 2, which shows a lower belt support forming part of the apparatus of FIG. 1 (but modified according to an exemplary embodiment of the present invention), a series of cooling pads 25*a*, 25*b*, 25*c*, 25*d* and 25*e* are supported from support carriage 20 via a series of bulkheads 26*a*, 26*b*, 26*c*, 26*d* and 26*e*. The spaces between the bulkheads 26*a*, 26*b*, 26*c*, 26*d* and 26*e* allow for the coolant to be removed from the space formed between the casting belts 10, 11 and the cooling nozzles (shown in more detail in FIGS. 4A and 4B). The cooling pads 25*a*, 25*b*, 25*c* and 25*d* are all supported directly by the bulkheads, while the end cooling pad 25*e* is partially supported by a cantilever support 27 to ensure rigidity.

In this particular embodiment, three support bulkheads 26*a*, 26*b* and 26*c* are all rigidly fixed between support carriage 20 and cooling pads 25*a* and 25*b*. However, bulkheads 26*d* and 26*e* are connected at their bottom ends to a pivotable subframe 28 supported by a bracket 29 and a pivot 30. An additional bulkhead 31 is also connected to subframe 28 and bracket 29 and this serves to support one end of cooling pad 25*c*. A small gap 32 is provided between bulkheads 26*c* and 31 to permit mechanical assembly. Thus, it will be seen from FIG. 2 that cooling pads 25*c*, 25*d* and 25*e* are able to tilt together around pivot 30 (as indicated by arrow C) while being supported by subframe 28. The tilting of pads 25*c*, 25*d* and 25*e* is accomplished by means of a tapered wedge, screw jack or hydraulic ram 33 mounted at one end of the fixed carriage 20 and at the other end on the pivotable subframe 28. The pivot 30 is preferably located about mid-length of the casting cavity 12, i.e. at a point where the cast strip is normally solid (or sufficiently solid for self-support). In a typical installation, the upstream region of the casting cavity 12 is convergent, with a basic convergence of about 0.02%, while the downstream tilting region can move from alignment with the upstream region, to non-alignment causing a lesser convergence of the downstream region of the casting cavity, or even a divergence of as much as about 0.4 to 1.0%.

Figure 3:
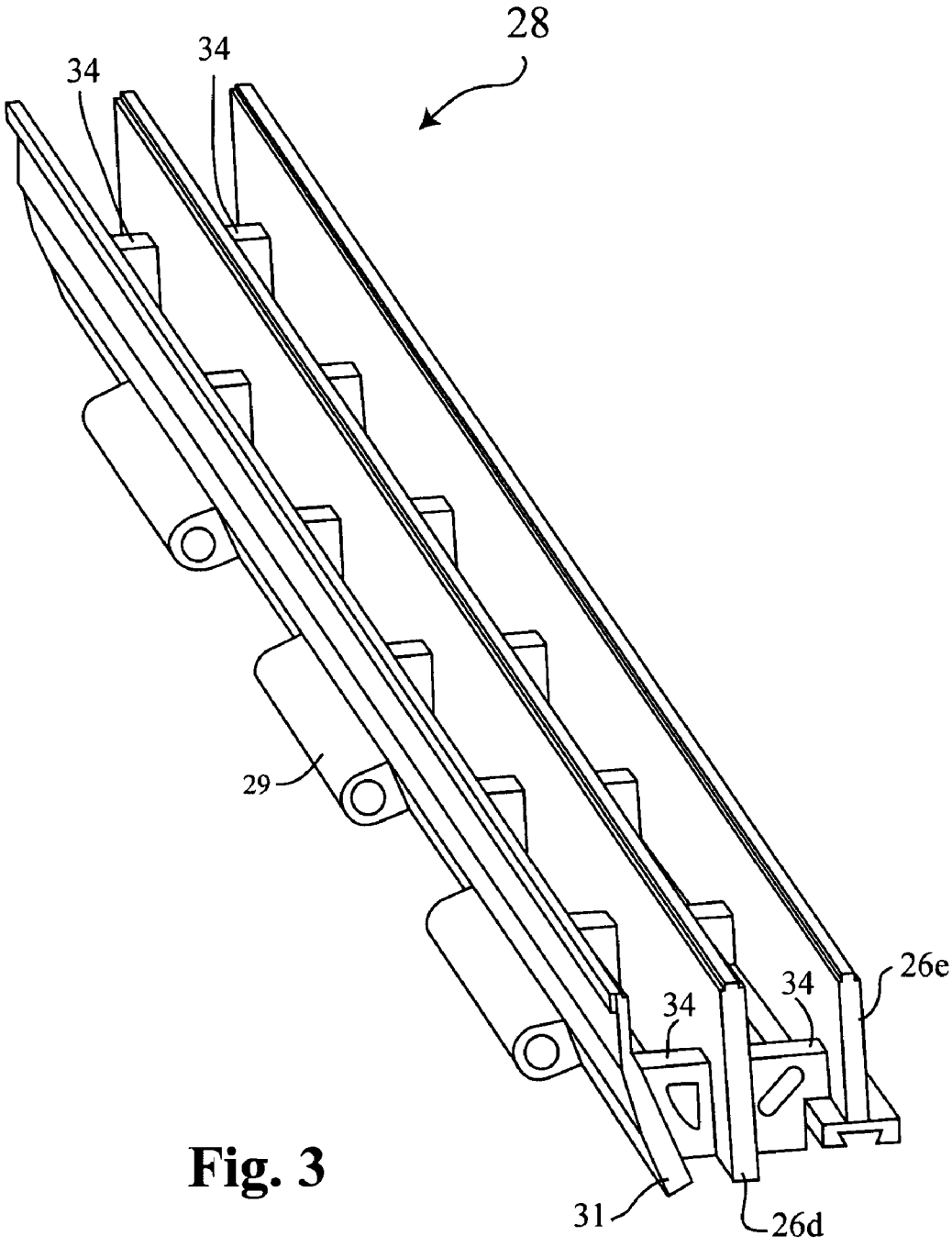
FIG. 3 is a perspective view of a pivoting or tilting section.

Further details of the tilting support portion are shown in FIG. 3, which is a perspective view of the subframe 28 in isolation showing more clearly the bulkheads 26*e*, 26*d* and 31. It will be seen that there is bracing 34 provided between the ribs for rigidity. In this illustration, the cooling pads 25*c*, 25*d* and 25*e* have been omitted, but in use they are mounted between the top ends of the illustrated bulkheads as shown in FIG. 2.

The attachment of the cooling pads to bulkhead 31 and bulkhead 26*c* requires some special consideration. The cooling pad 25*b* (FIG. 2) and is attached to bulkheads 26*b* and 26*c*, and cooling pad 25*c* is attached to bulkheads 31 and 26*d*. This means that the adjacent cooling pads 25*b* and 25*c* are free to separate as the pivotable subframe 28 moves with respect to the fixed portion of the carriage 20.

Figure 4A:
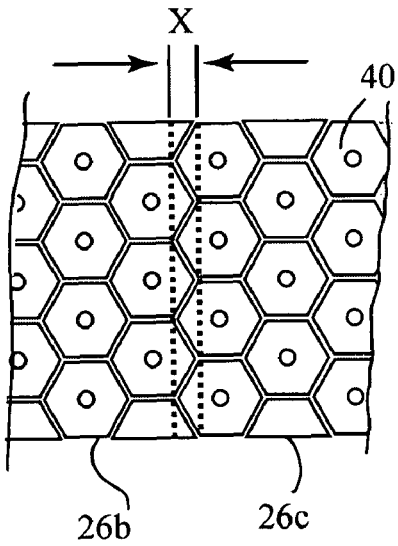
FIGS. 4A and 4B are plan views showing details of the connection of the pivoting section.
Figure 4B:
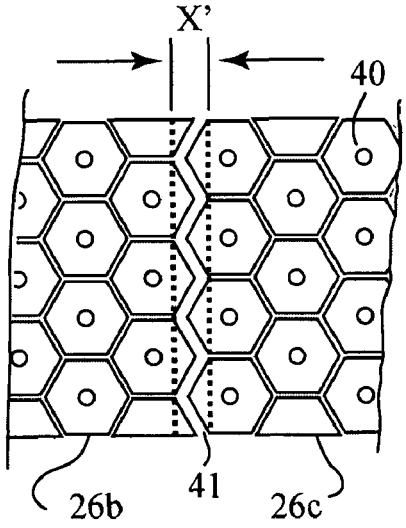

FIGS. 4A and 4B are plan views of the top surfaces of the cooling pads 25*b* and 25*c* showing hexagonal cooling nozzles 40 that cover the top surfaces, e.g. as described in U.S. Pat. No. 4,193,440 mentioned above. The nozzles 40 are mounted in a staggered manner to achieve a close-packed arrangement that is extended over the junctions between adjacent cooling pads. Thus, at the junction between cooling pads 25*b* and 25*c*, edge parts of the nozzles overhang the slight gap X between the pads in a staggered pattern, i.e. an edge part from a nozzle on one side of the gap projects between two adjacent edge parts of nozzles on the other side of the gap, and vice versa.

FIG. 4A represents the arrangement before rotation of the subframe 28 in direction C takes place, and FIG. 4B represents the arrangement after such rotation, and it will be seen that the gap X' in FIG. 4B is slightly wider then the gap X in FIG. 4A (but not by much, i.e. usually less than 1 mm). Although the gap between the pads increases when the rotation occurs, the gap 41 that opens between the nozzles has a zig-zag form, as shown. This means that the belt (not shown in these views) overlying the junction between the pads does not encounter a continuous straight line transverse gap that could cause the belt to sag between the pads. Instead, the zig-zag form of the gap provides support for the belt such that, considered transversely, various points on the belt remain supported from below at times when other points are unsupported due to passage over the gap. The supported and unsupported points alternate across the width of the belt as the belt passes over the junction. When the pivotable subframe 28 is rotated so as to create a more divergent cavity from the junction on, and the spaces between adjacent nozzles at the interface between these two pads begin to open up, the surfaces of the nozzles 40 become non-planar on opposite sides of the junction. In order to minimize any tendency for the edges of the nozzles to interfere with the movement of the belt passing over them, the pivot axis 30 is placed as far from the casting surface as practically possible (i.e. adjacent the lower end of the carriage, as shown).

During the rotation of subframe 28, the roller 16 remains in place with respect to the remainder of the carriage. The rotation of the subframe causes a slight decrease in the total length of the path followed by the belt, but the decrease is less than 1 mm compared to a typical total belt length of 5 m or more. Such a change is easily accommodated by the kind of belt tensioners (not shown) provided in this kind of casting apparatus. For example, the roller 16 may be mounted on horizontally slidable bearings and urged by spring means or the like to the right as seen in FIG. 2, resisted only by the tension of the belt.

The apparatus configured in this way may be used for casting a variety of different metals having different heat flux requirements by varying the rotation of the subframe 28 prior to casting in order to suit the cooling and heat flux characteristics of the metal to be cast. Whether or not tilting is required, and the degree of such tilting, for any particular metal may be determined empirically or by calculation from known metal cooling properties and casting conditions.

It will be appreciated that, while FIGS. 2 and 3 show a tiltable support mechanism for the lower belt of the apparatus of FIG. 1, the same arrangement could be provided for the upper belt either as well as, or alternatively instead of, providing the tiltable support for the lower belt. Therefore, just one, or alternatively both belts, may be made tiltable in the downstream region. It is generally found sufficient to make just one belt tiltable, and preferably just the lower belt as shown in the drawings.

The invention claimed is:

1. A method of continuously casting a metal slab in strip form directly from molten metal in which the molten metal is confined and solidified in a casting cavity oriented for horizontal slab casting, the cavity being vertically defined by upper and lower cooled, endless, flexible travelling casting belts supported by respective upper and lower belt supporting mechanisms that rigidly support the belts within the cavity, wherein an upstream fixed cooled casting region is provided in the casting cavity in which the supporting mechanisms confine the belts to fixed upstream paths, and a downstream cooled casting region is provided in the casting cavity in which the supporting mechanism of at least one of the belts in said downstream region is tiltable about a pivot having an axis of rotation extending transversely of said belts at a mid-region of the casting cavity to adjust the path of said at least one of the belts within said downstream region between a position aligned with the upstream fixed path of said at least one belt and a position out of alignment with said upstream fixed path, and depending upon the composition of the metal being cast and the exit temperature required, adjusting the downstream supporting mechanism of said at least one belt and thereby the downstream belt path such that the belts separate from the cast slab at a predetermined point within the casting cavity; wherein said upper and lower belt supporting mechanisms comprise cooling pads facing the belts and fixed to a plurality of bulkheads extending transversely of the belts, and wherein, for at least one of said belts, bulkheads adjacent to said downstream region are attached to a subframe tiltable on a support carriage about said pivot, whereas bulkheads adjacent to said upstream region are fixed to said support carriage.

2. A method according to claim 1, wherein the adjustable downstream casting cavity region is fixed in a predetermined position prior to the start of casting.

3. A method according to claim 1, wherein the metal being cast is an aluminum alloy.

4. An apparatus for the continuous casting of a metal slab in strip form comprising a pair of upper and lower, cooled, endless, flexible, movable casting belts defining therebetween a casting cavity oriented for horizontal slab casting, said belts being rigidly supported in said cavity by respective upper and lower belt supporting mechanisms, means for feeding molten metal into an upstream end of the casting cavity and means for removing a cast slab from a downstream end of the casting cavity, wherein the casting cavity includes an upstream cooled fixed casting region in which the supporting mechanisms are fixed and the belts are constrained to move in fixed paths, and a downstream cooled casting cavity region in which the supporting mechanism of at least one of the belts is mounted on a pivot having an axis of rotation extending transversely of said belts at a mid-region of the casting cavity and is adjustable about said pivot to provide said at least one belt with a downstream path that is variable between alignment with the fixed upstream path of said at least one belt and non-alignment with said fixed upstream path, and means for moving the adjustable supporting mechanism of said at least one belt to vary said downstream path, wherein said upper and lower belt supporting mechanisms comprise cooling pads facing the belts and fixed to a plurality of bulkheads extending transversely of the belts, and wherein, for at least one of said belts, bulkheads adjacent to said downstream region are attached to a subframe tiltable on a support carriage about said pivot, whereas bulkheads adjacent to said upstream region are fixed to said support carriage.

5. An apparatus according to claim 4, wherein the means for moving the adjustable supporting mechanism of said at least one belt comprise means selected from the group consisting of hydraulic cylinders, tapered wedges and screw jacks.

6. An apparatus according to claim 4, wherein the cooling pads have hexagonal cooling nozzles on surfaces that face said cooling belts, and said nozzles span gaps between the cooling pads in a staggered fashion.

7. A method according to claim 1, wherein said path of said at least one of the belts in said downstream region is adjusted between positions providing the belts with a divergence of between 0.4 to 1.0%.

8. A method according to claim 1, wherein adjustment of said at least one of the belts in said downstream region causes said at least one of the belts to be partially unsupported between said upstream and downstream regions, and wherein said supporting mechanism is configured between said upstream and downstream regions such that various points on the belt, considered in a transverse direction thereof, remain supported while other intervening points are unsupported as said at least one of the belts moves from said upstream to said downstream region.

9. Apparatus according to claim 4, wherein the downstream adjustable casting cavity region is adjustable between positions providing divergence of between 0.4 to 1.0%.

10. Apparatus according to claim 4, wherein said adjustment of said at least one of the belts in said downstream region causes said at least one of the belts to be partially unsupported between said upstream and downstream regions, and wherein said supporting mechanism is configured between said upstream and downstream regions such that various points on the belt, considered in a transverse direction thereof, remain supported at times when other intervening points are unsupported as said at least one of the belts moves from said upstream to said downstream region.

11. Apparatus according to claim 10, wherein said supporting mechanism has coolant outlet nozzles contacting a reverse surface of the belt, said nozzles being hexagonal in shape mounted in a close-packed staggered arrangement such that nozzles on opposite sides of a junction between said upstream and downstream regions extend partially across said junction from alternate sides thereof considered in said transverse direction.

12. A method according to claim 3, wherein the upstream fixed casting cavity region has a belt convergence in the range of 0.015% to 0.025% and the downstream adjustable casting cavity region is adjustable between a position providing the belts with the same convergence as said fixed upstream region, and a position providing less convergence or a divergence of up to 1%.

13. An apparatus according to claim 4, wherein the upstream fixed casting cavity region has a convergence in the range of 0.015% to 0.025%, and the downstream adjustable casting cavity region is adjustable between positions providing the same convergence as said fixed region and a divergence of up to 1%.

* * * * *